United States Patent [19]

Nishigami et al.

[11] 3,995,573

[45] Dec. 7, 1976

[54] SEWING MACHINE WITH SLANTED BED PLATE

[75] Inventors: Teiichi Nishigami, Osaka; Toshiyuki Hayashi, Amagasaki, both of Japan

[73] Assignee: Maruzen Sewing Machine Co., Ltd., Moriguchi, Japan

[22] Filed: Feb. 17, 1976

[21] Appl. No.: 658,183

[52] U.S. Cl. ..... 112/258

[51] Int. Cl.[2] ..... D05B 75/00

[58] Field of Search ..... 112/260, 258, 217.1

[56] References Cited

UNITED STATES PATENTS

| | | | |
|---|---|---|---|
| 2,247,383 | 7/1941 | Hohmann et al. | 112/260 |
| 2,469,968 | 5/1949 | Kessler | 112/260 X |
| 2,652,800 | 9/1953 | Scheiwiller | 112/260 |
| 2,741,202 | 4/1956 | Pfaff | 112/258 |
| 3,741,618 | 6/1973 | Newman | 112/258 |

*Primary Examiner*—George H. Krizmanich
*Attorney, Agent, or Firm*—Arnstein, Gluck, Weitzenfeld & Minow

[57] ABSTRACT

A sewing machine in which the portion of the bed plate disposed forwardly of the needle or operating area is inclined downwardly. This perceptually brings the needle closer to the operator and provides improved visibility of the working area.

4 Claims, 4 Drawing Figures

SEWING MACHINE WITH SLANTED BED PLATE

BACKGROUND OF THE INVENTION

The present invention relates to improvements in the work supporting surfaces or bed plates of sewing machines. More particularly, the present invention is applicable to flat bed type sewing machines and to the types of sewing machines which may be selectively convertible from flat bed to free arm types and vice versa.

Conventional type sewing machines include a planar bed plate which in the case of a flat bed type is substantially coplanar with the work supporting surface of the cabinet on which the machine is supported. Correspondingly, in the case of a convertible type machine which utilizes a complementary U-shaped shoe, the work supporting surface similarly is planar, although disposed in a parallel plane above the planar work supporting surface of the cabinet.

SUMMARY OF THE INVENTION

In accordance with our invention we provide a downwardly inclined or slanted surface along the leading or forward portion of the bed plate or work supporting surface of the machine. This perceptually brings the needle closer to the operator and provides improved visibility of the working area.

BRIEF DESCRIPTION OF A PREFERRED EMBODIMENT

Figure 1:
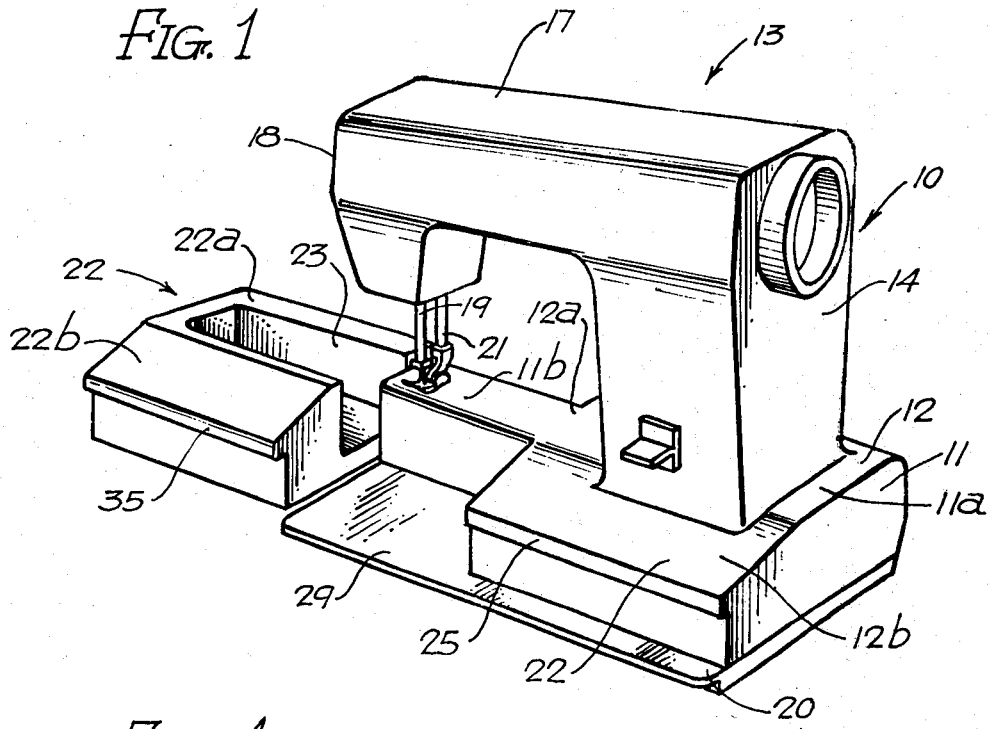
FIG. 1 is a perspective view of a convertible type sewing machine head with the complementary shoe portion of the bed plate in separated relation.
Figure 2:
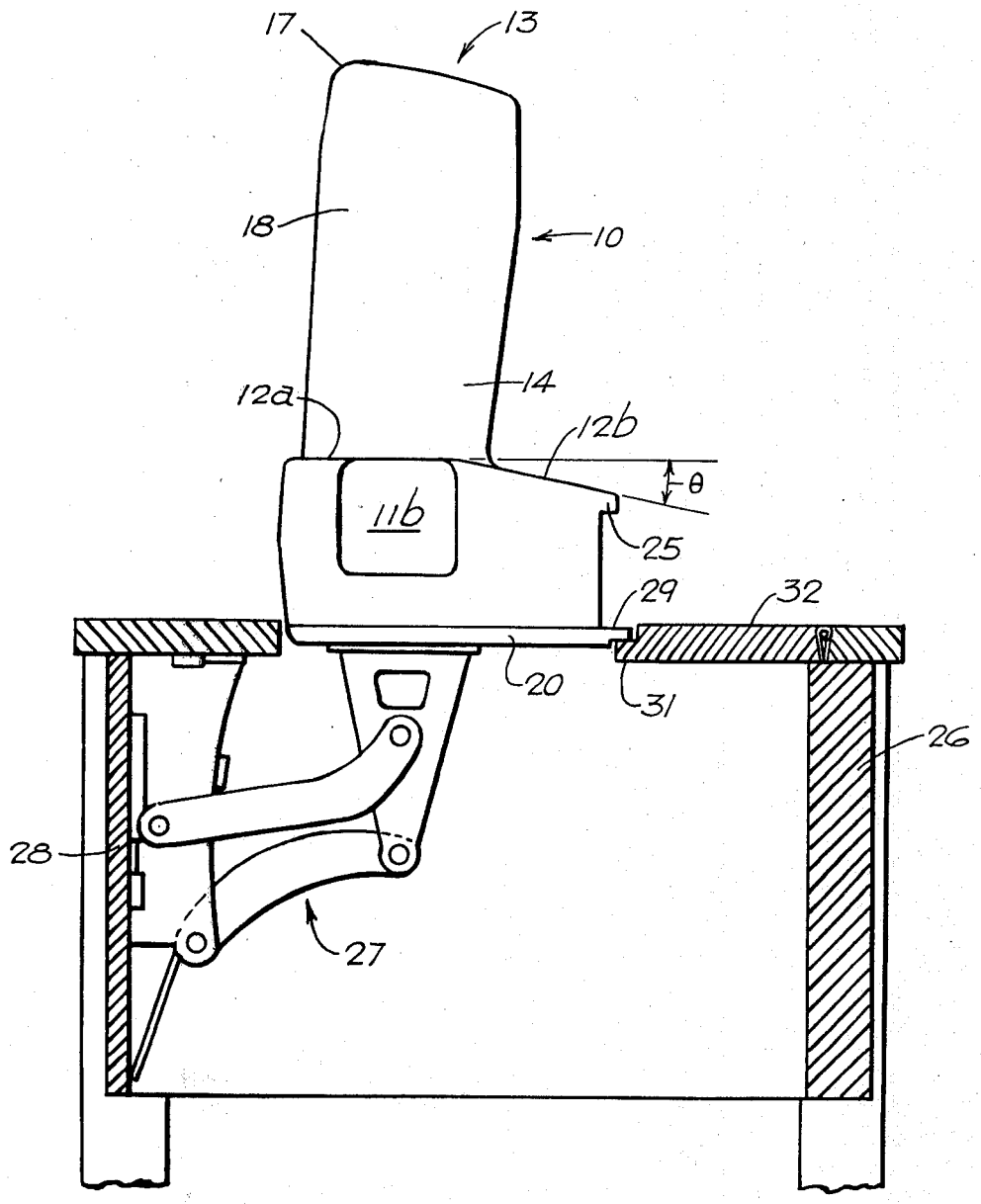
FIG. 2 is a vertical cross-sectional view showing the machine head mounted in a cabinet with the machine head disposed in a free arm mode of operation.

Referring to FIG. 1, there is illustrated a sewing machine which is convertible for use either as a free-arm or as a flat bed type. The machine, indicated generally by the numeral 10, includes a hollow base 11, shaped substantially as shown, and having a work supporting surface or bed plate 12. Secured to the base 11 is a head 13 which includes a vertically disposed hollow standard 14 carrying an over-hanging arm 17 terminating in a hollow head 18 in which is mounted a reciprocatory needle bar 19 and presser bar 21. The base 11 is generally T-shaped in plan and includes a main body portion **11*a* and a longitudinally extending integral arm 11*b* of reduced width disposed in vertical registration with the over-hanging arm 17. Conventional loop taker and feed mechanisms, not shown, are housed within the base 11. The bed plate 12 of the base 11 includes a main horizontal planar portion 12*a* and an integral planar forward portion 12*b* which is downwardly inclined away from the main portion. Advantageously, the angle of inclination $\theta$ in a downwardly direction of the planar portion 12*b* is approximately 14° in relation to the horizontal planar portion 12*a* (FIG. 2). However, it will be understood that the angle $\theta$ may range between 10° to 45°. The planar forward portion 12*b* terminates in an over-hanging lip 25 projecting beyond the forward vertical wall of the base 11. The machine 10 is mounted on a base plate 20**.

The auxiliary component or shoe 22 is shaped substantially as illustrated in FIG. 1 and is constructed to be complemental to the base 11. The shoe 22 includes a recess 23 which terminates in depth short of the bottom of the shoe and is adapted to receive the arm **11*b*. The shoe includes a generally U-shaped horizontal planar portion 22*a* surrounding the recess 23 and a forward downwardly inclined surface portion 22*b* adjacent the forward leg of the U-shaped surface portion 22*a*. The surface portion 22*b* terminates in an over-hanging lip 35. It will be understood that when the shoe 22 is assembled to the base 11 by sliding the shoe 22 on base plate 20, the respective horizontal and inclined surfaces of the base and shoe 12*a*, 22*a*, 12*b* and 22*b* are in coplanar registration affording a continuous work supporting surface. It will be noted that the inclined surface portions 12*b* and 22*b* join the horizontal surface portions 12*a* and 22*a*** along a line which is in close proximity to the needle and presser bar corresponding to the operating area of the machine.

Means, not illustrated, are provided on the base 11 and shoe 22 for locking the same together in assembled relationship.

Referring to FIG. 2, the machine 10 is shown mounted in a cabinet 26 with the base plate 20 supported on a parallelogram linkage arrangement 27 anchored to a side wall 28 of the cabinet. The machine is disposed in a free arm mode of operation with lip 29 of the base plate 20 resting on a complementary lip 31 of a panel 32 hinged to the cabinet 26. The panel 32 may be swung upwardly to afford clearance to permit moving the machine to the flat bed mode or to storage mode within the cabinet.

Figure 3:
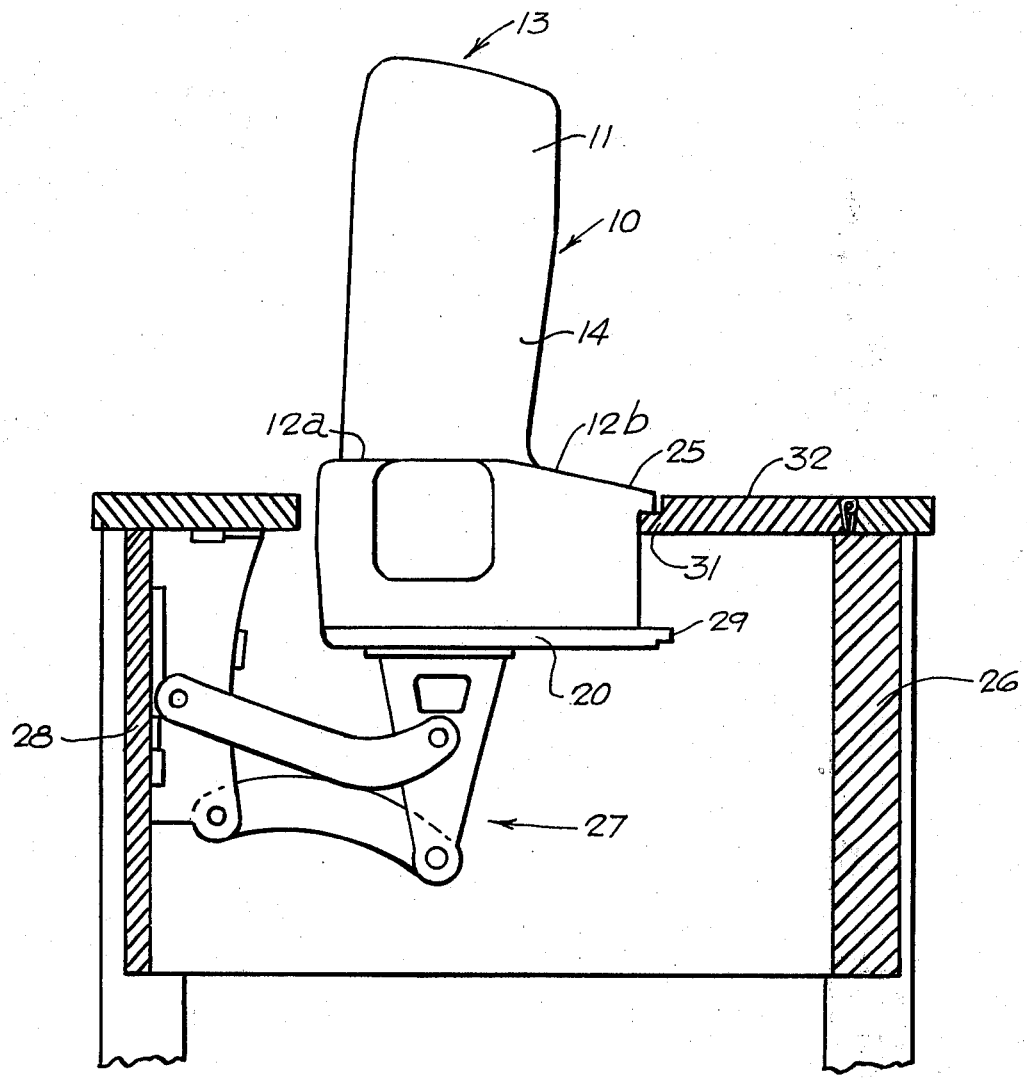
FIG. 3 is a view similar to FIG. 2 but showing the head disposed in a flat bed mode of operation.

In FIG. 3, the machine 10 is illustrated as disposed in a flat bed mode of operation with the lips 25 and 35 rested on the lip 31 of panel 32. In such mode planar work surfaces **12*b* and 22*b*** afford continuity between the horizontal work surface of the cabinet and the operating area of the machine.

In either mode of operation the operating area of the machine is disposed at a higher elevation than the downwardly inclined planar surfaces **12*b* and 22*b*** which are between the operator and the operating area. Thus, perceptually the operating area is brought closer to the eyes of the operator thereby providing improved visibility of the material being sewn.

Figure 4:
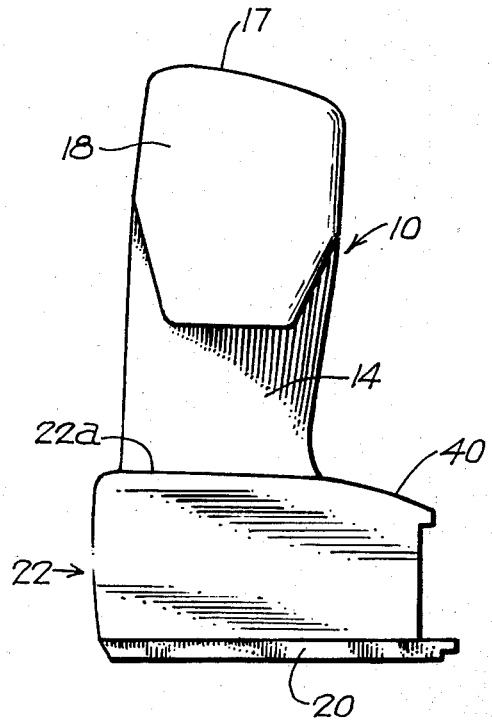
FIG. 4 is an end elevational view showing a modified embodiment of the invention.

FIG. 4 illustrates a modified embodiment of our invention in which surfaces of the forward portions 40 corresponding to the portions **12*b* and 22*b*** of the bed plate are arcuate, preferably assuming a gentle curve.

Various changes coming within the spirit of our invention may suggest themselves to those skilled in the art; hence, we do not wish to be limited to the specific embodiments shown and described or uses mentioned, but intend the same to be merely exemplary, the scope of our invention being limited only by the appended claims.

We claim:

1. In combination, a free arm type sewing machine having a main body portion having a first bed plate including a longitudinally extending arm of reduced width, a separable unitary auxiliary body portion having a recess therein to receive said arm and being attachable to said main body portion by sliding longitudinal movement, said auxiliary body portion including a second bed plate complemental to said first bed plate with corresponding surface portions of said first and second bed plates having corresponding surface contours, each of said first and second bed plates having a forward surface portion which is inclined upwardly from the front edges of the body portion, each inclined surface portion merging into a respective horizontal surface portion on each body portion along a longitudinal line disposed immediately forwardly of the needle bar, the respective inclined and horizontal surface portions of said body portions being substantially coplanar when said body portions are in assembled relation.

2. The invention as defined in claim 1 in which the inclined forward surface portions are planar and are disposed at an angle of substantially 14° in relation to the rearwardly disposed horizontal surface portions.

3. The invention as defined in claim 1 in which the inclined forward surface portions are planar and are disposed at an angle within the range of 10°–45° in relation to the rearwardly disposed surface portions.

4. The invention as defined in claim 1 in which the forward surface portions are arcuate in contour.

* * * * *